United States Patent [19]

Paschakarnis et al.

[11] 4,268,737

[45] May 19, 1981

[54] CORDLESS INDUCTIVE FLAT IRON APPARATUS

[75] Inventors: Peter Paschakarnis, Schwebheim; Wolfgang Fischer, Königsberg, both of Fed. Rep. of Germany

[73] Assignee: Sachs-Systemtechnik GmbH, Schweinfurt am Main, Fed. Rep. of Germany

[21] Appl. No.: 895,515

[22] Filed: Apr. 11, 1978

[51] Int. Cl.[3] ..... H05B 6/10; H05B 6/06

[52] U.S. Cl. ..... 219/10.49 R; 219/10.57; 219/10.77; 219/10.67

[58] Field of Search ..... 219/10.49, 10.57, 10.61, 219/10.67, 10.75, 497, 246, 10.77, 494, 10.79

[56] References Cited

U.S. PATENT DOCUMENTS

| | | | |
|---|---|---|---|
| 2,133,494 | 10/1938 | Waters | 219/10.49 |
| 3,634,652 | 1/1972 | Shimizu et al. | 219/497 |
| 3,742,174 | 6/1973 | Harnden | 219/10.49 |
| 3,742,178 | 6/1973 | Harnden | 219/10.49 |
| 3,781,503 | 12/1973 | Harnden et al. | 219/10.49 |
| 3,781,506 | 12/1973 | Ketchum et al. | 219/10.77 |
| 3,821,516 | 6/1974 | Hayes et al. | 219/494 |
| 4,009,359 | 2/1977 | Tallmadge et al. | 219/10.55 B |
| 4,032,389 | 6/1977 | Joyce | 219/10.77 |
| 4,081,645 | 3/1978 | Javes et al. | 219/10.55 E |

FOREIGN PATENT DOCUMENTS

| | | | |
|---|---|---|---|
| 2505341 | 8/1976 | Fed. Rep. of Germany | 219/10.49 |
| 2626207 | 12/1977 | Fed. Rep. of Germany | 219/10.49 R |

*Primary Examiner*—B. A. Reynolds
*Assistant Examiner*—Philip H. Leung
*Attorney, Agent, or Firm*—Toren, McGeady and Stanger

[57] ABSTRACT

An apparatus in which a cordless flat iron is energized by a one or more high-frequency oscillators subjacent the normally horizontal work supporting surface of an associated ironing board. The sole plate of the iron consists of a thin layer of conductive material and is electrically and thermally insulated from the handle of the flat iron. The magnetic field of a polarity alternating at high frequency which is generated above the work supporting surface by the oscillator generates eddy currents in the sole plate when the flat iron is placed on the surface or separated from the surface by normally nonconductive textile material to be ironed.

8 Claims, 8 Drawing Figures

CORDLESS INDUCTIVE FLAT IRON APPARATUS

This invention relates to a cordless flat iron apparatus, and particularly to an arrangement in which a flat iron is energized electrically, but not connected to a house current outlet by a cord.

A cord or a cable connecting a flat iron to a wall outlet is a notorious source of accidents. It is known from U.S. Pat. No. 2,415,688 to install the primary winding of a transformer in a stand on which a flat iron carrying the secondary transformer winding may be placed from time to time. A heating coil connected to the secondary transformer winding raises the temperature of the flat iron as long as the iron is located on the stand. It is a disadvantage of the known arrangement that the iron cannot be used while it is being heated, and that a constant temperature cannot be maintained during use.

A primary object of the invention is to provide a cordless flat iron apparatus which retains the basic advantages of the known iron not encumbered by a cord or cable while permitting energy to be supplied to its sole plate while the iron is in use.

With this object in view, the apparatus of the invention includes a flat iron, an ironing board, and one or more energy transmitters on the board. The iron includes a sole plate of conductive material and a handle electrically and thermally insulated from the sole plate. The ironing board, in its normal operating position, defines an approximately horizontal, upwardly directed supporting surface. The energy transmitter includes a high frequency oscillator and at least one coil which is secured to the ironing board and generates a magnetic field of a polarity alternating at high frequency above the work supporting surface so that it can inductively transmit energy to the sole plate when the flat iron is placed on the surface.

Other features, additional objects, and many of the attendant advantages of this invention will readily be appreciated as the same becomes better understood by reference to the following detailed description of preferred embodiments when considered in connection with the appended drawing in which.

Figure 1:
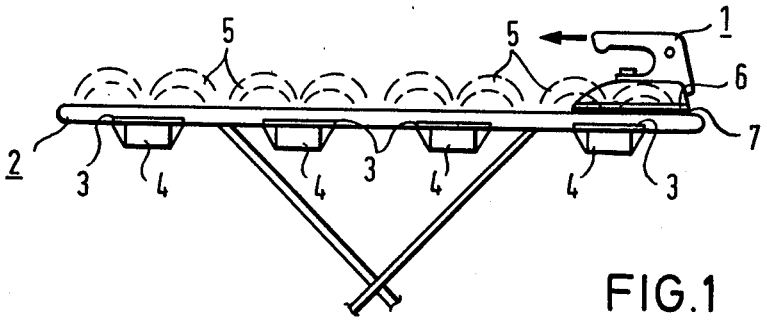
FIG. 1 shows the apparatus of the invention in fragmentary side elevation.

Referring now to the drawing in detail, and initially to FIG. 1, there is seen a flat iron whose handle 1 is thermally and electrically insulated from the sole plate 7 by a layer of silicone rubber 6. The sole plate 7 may be a foil of chrome nickel steel adhesively secured to the insulating layer 6 or it may be a metal layer formed on the layer 6 by spraying or by electrodeposition. The thickness of the sole plate may be of the order of 0.4 to 1.0 millimeter so as to have low thermal capacity, and is 0.7 millimeter in this instance.

The flat iron normally travels over the work supporting surface of an ironing board 2 consisting entirely of non-conductive material, but otherwise conventional in its function and structure except as specifically described. A piece of textile material to be ironed is normally supported on the top surface of the board 2 in a conventional manner, not shown. The board 2 has a width, at right angles to the plane of FIG. 1, which is only a small fraction, typically less than 20%, of its illustrated length. Four coils 3 are mounted on the board in longitudinal, spaced alignment and are elements of the tank circuits of respective oscillators 4.

The magnetic fields 5 respectively generated by the oscillators 4 reverse their polarity at a frequency of 20,000 to 30,000 cycles per second, typically 23,000 cycles. In the illustrated center-to-center spacing of approximately 20 centimeters, the oscillators are designed in a conventional manner for an individual output of approximately 400 watts.

When the flat iron travels over the board in the direction indicated by an arrow in FIG. 1, the sole plate intersects the magnetic fields 5, and eddy currents of corresponding high frequency are induced therein to heat the sole plate to a desired working temperature within 1 or 2 seconds. The thermal energy lost by contact with the non-illustrated textile material is replaced continuously by the oscillators 4. The relatively close spacing of the coils 3 permits a uniform temperature to be maintained in the sole plate 7 regardless of the position of the iron on the work supporting surface of the ironing board 2.

The handle 1, the layer 6, and the portion of the flat iron connecting the layer to the handle may constitute a unitary body of silicone. The structural details of the flat iron are not, however, of significance to this invention.

The modified ironing arrangement illustrated in FIG. 2 differs from that described above with reference to FIG. 1 by the provision of a single oscillator or generator 4 arranged at one longitudinal end of the ironing board, and supplying high frequency current to four coils 3 mounted on a common insulating frame 10 below the working surface of the board 2 at a distance that may be adjusted in a manner not specifically illustrated and indicated by a double arrow 11. Plastic screws whose heads abut against the underside of the frame 10, and whose shanks are threadedly received in the board 2 have been found to provide stepless adjustment of the downward spacing of the coils 3 from the supporting surface of the board, but other means for stepless or stepwise adjustment will readily suggest themselves.

The top surface of the ironing board 2 is padded in the conventional manner, not specifically shown. In the arrangement illustrated in FIG. 3, a rigid, horizontal carrier 8 extends from one longitudinal end of the ironing board proper to provide a stand for the flat iron when it is not in use. To prevent the temperature of the iron from dropping too far during an idle period, an additional coil 9 is provided on the underside of the carrier 8. The coils 3 and 8 are furnished with high-frequency alternating current from a common oscillator 4, also mounted subjacent the carrier 8.

Figure 2:
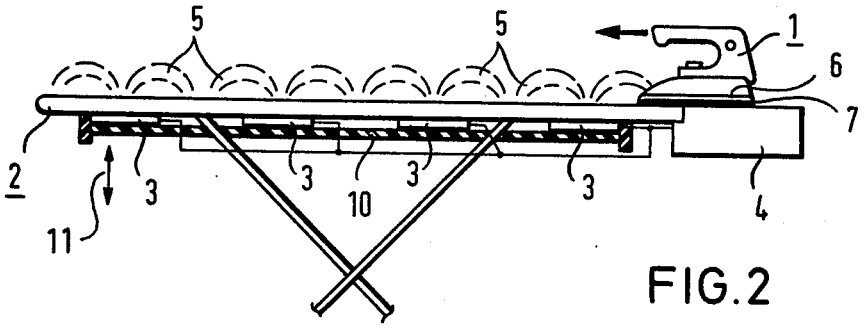
FIGS. 2 and 3 illustrate modifications of the apparatus of FIG. 1 in corresponding views.
Figure 3:
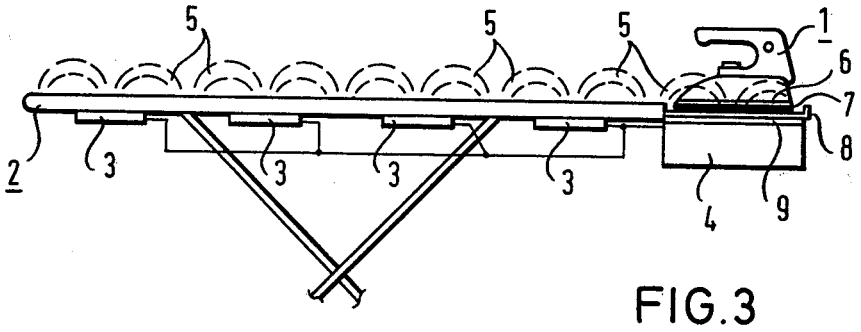

It will be appreciated that the features distinguishing FIGS. 2 and 3 from FIG. 1 are not mutually exclusive. Thus, the ironing board of FIG. 1 may be provided with several oscillators mounted on an adjustable frame in the manner of FIG. 2, and a stand for the flat iron provided with its own oscillator and coil may be attached to one end in the manner of FIG. 3.

Figure 4:
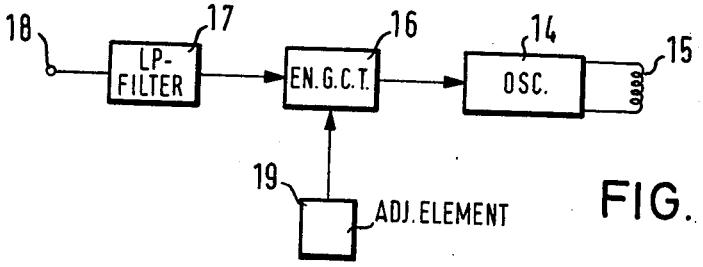
FIG. 4 is a block diagram of an oscillator system for use in any one of the embodiments of FIGS. 1 to 3.

FIG. 4 is a block diagram of a power supply for any one of the oscillators 4 shown in FIGS. 1 to 3. The illustrated high-frequency generator or oscillator 14 has a tank circuit including a coil 15. It is energized by a circuit 16 which draws a line current of less than 100 cycles, normally 60 cycles at 110 volts, from terminals 18 through a low-pass filter 17. The energizing circuit 16 may be of the known type which includes a phase-controlled thyristor circuit in which the angle of conductance of the thyristor can be varied by an adjusting element 19. The element 19 permits the output voltage or output current of the circuit 16 to be varied in a manner to control the strength of the magnetic field generated by the coil 15, and thereby the temperature of an associated flat iron.

Figure 5:
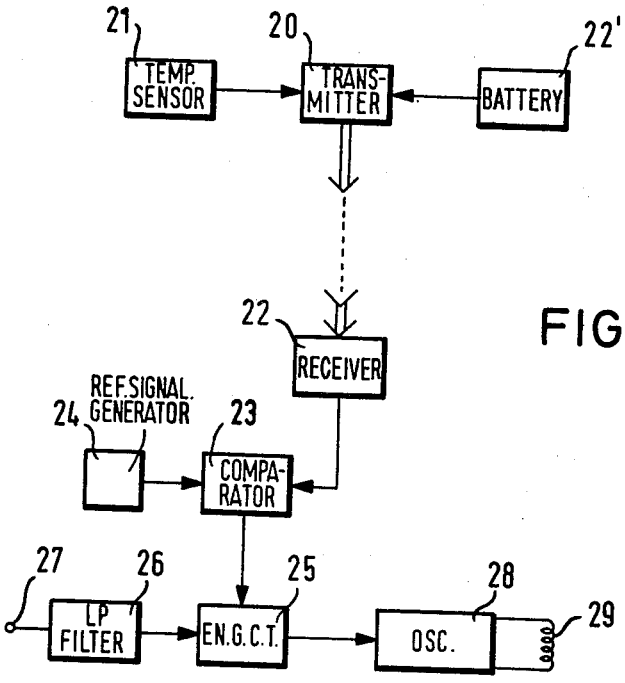
FIG. 5 shows a modified oscillator system and its temperature-responsive controls in a block diagram.

A thermostatically controlled high-frequency generator is shown diagrammatically in FIG. 5. A wireless transmitter 20 transmits an infrared signal or an ultrasonic signal to a receiver 22 on the ironing board. The transmitter signal is modulated by the output signal of a temperature sensing device 21 which senses the temperature of the sole plate on the flat iron either directly or through a fixed thickness of the insulating material constituting other portions of the flat iron. Any known type of modulation may be employed, but it is preferred that the signal of the transmitter 20 be intermittent, and that the sensor 21 control the length of consecutive pulses emitted by the transmitter 20 as is known in itself. The transmitter has its own power supply 22' which may be a primary or secondary battery, such as a dry cell which may be rechargeable, and provides direct current.

The receiver 22 is arranged on the ironing board subjacent the work supporting surface as shown for the coils 3 in each of FIGS. 1 to 3, but is preferably offset laterally from the padding of the board. The signal demodulated by the receiver 22 and proportional to the sensed temperature is fed to a comparator circuit 23 together with a reference signal adjustable for a desired temperature value on a signal generator 24.

The output signal of the comparator 23 controls an energizing circuit 25 which draws house current from terminals 27 through a low-pass filter 26 in the manner described above with reference to the circuit 16. The output of the energizing circuit 25 thus varies in accordance with the energy requirements of the flat iron for maintaining a desired temperature to vary the intensity of the high-frequency magnetic field produced by a coil 29 of an oscillator 28. More than one coil 29 may be connected to a signal oscillator in the manner shown in FIGS. 2 and 3, or may constitute elements of the tank circuit of the oscillator.

The comparator circuit may produce an output signal indicative of any positive or negative difference between signals furnished by the receiver 22 and the adjustable reference source 24 so as to function as a two-point regulator. The comparator also may constitute a subtraction stage whose output is proportional to the difference of the two input signals so that the control system of FIG. 5 functions as a continuous servo-mechanism control circuit.

Figure 6:
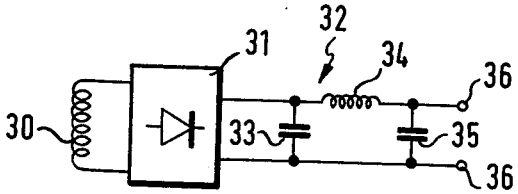
FIG. 6 is a block diagram of an alternative voltage source for the device of FIG. 5.

The battery described with reference to FIG. 5 may be replaced by a device shown in FIG. 6 which derives the voltage needed for operating the transmitter 20 from the magnetic field or fields 5.

A coil 30 is arranged in the body of the flat iron and is exposed to a magnetic field 5 which induces high-frequency alternating current in the coil. A rectifier stage 31, such as a rectifier bridge circuit, is connected to the coil 30 to rectify the alternating current, and a filter stage 32 further smoothes the output of the rectifier stage. The filter stage may be of the conventional type in which two capacitors 33, 35 are connected in parallel circuit to the output conductors of the rectifier stage, an inductance 34 being arranged in one of the conductors in series circuit with the two capacitors. The output terminals 36 of the filter stage 32 supply direct current of practically constant amplitude to the transmitter 20.

Figure 7:
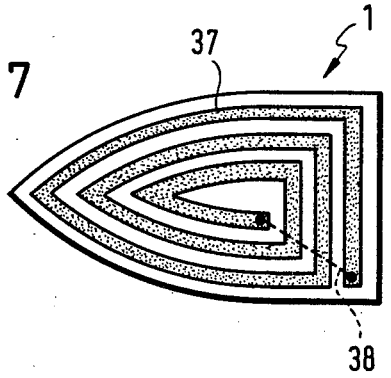
FIGS. 7 and 8 illustrate respective flat irons for use in the embodiments of FIGS. 1 to 3 in bottom plan view.
Figure 8:
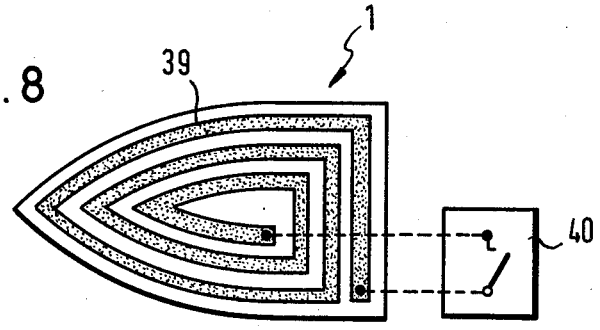

Preferred embodiments of sole plates are illustrated in FIGS. 7 and 8 in respective bottom views. A long strip of foil 37 is placed on the exposed surface of the insulating layer in a flat spiral shaped in such a manner as to provide an approximately uniform distribution of the several turns of strip material over the bottom face of the flat iron. Each individual turn is similar in shape though not necessarily in size to the overall contour of the bottom face. The free ends of the innermost and outermost turns are permanently connected in the flat iron of FIG. 7 by a conductor 38 embedded in the plastic material of the flat iron to close the spiral into a short-circuited coil. The otherwise closely similar flat iron shown in FIG. 8 is provided with a temperature-sensitive switch 40 instead of the conductor 38 for short-circuiting the foil spiral 39 when the temperature of the flat iron drops below a desired working temperature. The switch 40 may be adjustable in a conventional manner, not shown.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A cordless flat iron apparatus comprising:

(a) a flat iron including a sole plate of conductive material and a handle electrically and thermally insulated from said sole plate;

(b) an ironing board movable into a position to define an approximately horizontal, upwardly directed work supporting surface;

(c) energy transmitting means carried on said ironing board and including oscillator means and a plurality of coils associated with said oscillator means and positioned closely subjacent said surface for generating a magnetic field of a polarity alternating at high frequency above said work supporting surface in said position of the ironing board and for thereby inductively transmitting energy to said sole plate when said flat iron is placed on said surface, said coils being spaced from each other in a direction parallel to said surface, each of said coils being an element of an independent high frequency oscillator;

(d) temperature sensing means for sensing the temperature of said sole plate by said iron;

(e) transmitter means operatively connected to said sensing means providing a wireless signal in response to the sensed temperature;

(f) means for supplying power to said transmitter wherein the output of one of said coils is connected to a rectifier stage, said rectifier stage being coupled to a smoothing stage, said smoothing stage having output terminals for supplying power to said transmitter;

(g) receiver means carried by said ironing board for receiving said signal, and a reference signal generator carried by said board to generate a reference signal;

(h) a comparator circuit connected to said receiver means and to said reference generator for comparing the received signal and said reference signal, and for controlling the output of said oscillator means in response to the relationship between the compared signals; and (i) an additional surface is also included adjacent to said work supporting surface for depositing said iron, an additional coil being provided subjacent said additional surface, said coil being coupled to one of the high frequency oscillators.

2. The cordless flat iron apparatus as set forth in claim 1, wherein said sole plate includes a flat spiral of sheet metal having a plurality of turns insulated from each other, and conductive means for short-circuiting said spiral.

3. The cordless flat iron apparatus as set forth in claim 2, wherein said conductive means includes a temperature-responsive normally closed switch interrupting the short circuit in said spiral if a predetermined temperature is exceeded.

4. The cordless flat iron apparatus as set forth in claim 1, wherein said oscillator means includes at least one coil, and means for securing said coil to said ironing board in a plurality of respective, alternative positions subjacent to said surface and differently spaced from the same in a transverse direction.

5. The cordless flat iron apparatus as set forth in claim 1, wherein said oscillator means includes power supply means for converting alternating current of less than 100 CPS to high frequency alternating current and at least one coil closely subjacent said surface and connected to said power supply.

6. The cordless flat iron apparatus as set forth in claim 1, wherein said energizing means includes means for producing an alternating current in response to said magnetic field, and rectifying means for rectifying said alternating circuit.

7. The cordless flat iron apparatus as set forth in claim 1, wherein said wireless signal is an infrared signal.

8. The cordless flat iron apparatus as set forth in claim 1, wherein said wireless signal is an ultrasound signal.

* * * * *